US012723601B2

(12) United States Patent
Liu et al.

(10) Patent No.: US 12,723,601 B2
(45) Date of Patent: Sep. 1, 2026

(54) HUB FOR A COOLING FAN

(71) Applicant: Brose Fahrzeugteile SE & Co. Kommanditgesellschaft, Würzburg, Würzburg (DE)

(72) Inventors: Huangang Liu, Shanghai (CN); Yixin Hua, Shanghai (CN); Zhongyang Wang, Shanghai (CN); Hengjun Wang, Taicang (CN)

(73) Assignee: Brose Fahrzeugteile SE & Co. Kommanditgesellschaft, Würzburg (DE)

( * ) Notice: Subject to any disclaimer, the term of this patent is extended or adjusted under 35 U.S.C. 154(b) by 0 days.

(21) Appl. No.: 19/085,727

(22) Filed: Mar. 20, 2025

(65) Prior Publication Data

US 2025/0290526 A1 Sep. 18, 2025

(30) Foreign Application Priority Data

Mar. 20, 2024 (CN) ..... 202410319397.4

(51) Int. Cl.
*F04D 29/70* (2006.01)
*F04D 19/00* (2006.01)
*F04D 29/32* (2006.01)

(52) U.S. Cl.
CPC ..... *F04D 29/703* (2013.01); *F04D 19/002* (2013.01); *F04D 29/329* (2013.01)

(58) Field of Classification Search
CPC .... F04D 29/703; F04D 29/329; F04D 19/002; F04D 29/384; F04D 29/70; F01D 19/002; F04B 47/005
See application file for complete search history.

(56) References Cited

U.S. PATENT DOCUMENTS

2006/0093485 A1* 5/2006 Horng ..... F04D 29/38 416/198 R
2011/0135494 A1* 6/2011 Nicgorski ..... F04D 29/329 416/93 R

FOREIGN PATENT DOCUMENTS

KR 20230071987 A * 5/2023 ..... F04D 29/384

* cited by examiner

*Primary Examiner* — Nathaniel E Wiehe
*Assistant Examiner* — Maxime M Adjagbe
(74) *Attorney, Agent, or Firm* — Dickinson Wright PLLC

(57) ABSTRACT

The disclosure shows a hub for a cooling fan, comprising a first sand venting structure at a first surface of the hub, a second sand venting structure at a second surface of the hub, and venting holes connecting the first surface and the second surface, wherein the first sand venting structure is configured to transport sand to the venting holes and the second sand venting structure is configured to transport the sand from the venting holes out of the hub.

16 Claims, 9 Drawing Sheets

HUB FOR A COOLING FAN

CROSS-REFERENCE TO RELATED APPLICATIONS

This application claims priority to German Application No. DE 102024107336.5 filed Mar. 14, 2024 and Chinese Application No. CN 202410319397.4 filed Mar. 20, 2024, the entire disclosures of which are incorporated by reference herein.

TECHNICAL FIELD

The present disclosure relates to a hub for a cooling fan, in particular for a vehicle.

BACKGROUND

Considering the architecture of a vehicle, cooling fans are used in an area of a motor cooling and/or an air-conditioning compressor, for example. In relation to a coordinate system of the vehicle, the rotation plane of the fan may be in particular oriented towards a vehicles head. For example, DE 10 2015 106070 A1 describes an axial fan for a cooling fan module has a cup-shaped central hub with a front wall intended to be connected to the rotor of an electric motor at connection points and with a side wall from which a plurality of outer blades extend.

When driving in sandy environments, such as deserts, lots of sand may be gathered in the inner side of a hub of the cooling fan.

Common hub structures may not consider any issue of sand prevention. Disadvantageously, this may cause a bad unbalance of the cooling fan. In particular, the cooling fan with an out-of-standard balance value may cause in higher continuously vibrations which may be uncomfortable for a customer. Furthermore, structural damage of the cooling fan may occur.

SUMMARY

In view of the above, an object of the present disclosure is to provide anew and improved hub for a cooling fan in which balance value of the cooling is reduced also in sandy environment to a certain range to achieve fewer vibration and acoustics, for example if the cooling fan is working at a high-speed rotation.

According to an aspect of the disclosure, a hub for a cooling fan comprises a first sand venting structure at a first surface of the hub, a second sand venting structure at a second surface of the hub, and venting holes connecting the first surface and the second surface, wherein the first sand venting structure is configured to transport sand to the venting holes and the second sand venting structure is configured to transport the sand from the venting holes out of the hub.

Another aspect of the present disclosure is to implement a sand venting structure to the hub of a cooling fan to guide the sand out of the area of the hub. Further, the sand venting structure may guide the sand in the area of the hub for better balancing while the vehicle driving in a desert or the like.

In other words, the disclosure provides a hub comprising two sand venting structures at different, in particular opposite, sides of the hub. The sand venting structures are connected by venting holes providing the sand to slide or flow from one sand venting structure to the other for better balancing of the cooling fan.

The first and second surfaces are at corresponding first and second sides of the hub. The first sand venting structure is formed at a first surface of the hub. The first surface may be a rear surface of the hub. The second sand venting structure is formed at a second surface of the hub. The second surface may be a front surface of the hub. The first and second surfaces may be in parallel to each other, in particular forming two opposite surfaces of the hub.

The venting holes may enable the sand to slide from the first to the second surface. The venting holes may be provided adjacent to each other in a circumferential direction of the hub, wherein the venting holes may be in particular spaced from each other and arranged to form a ring shape. Furthermore, the venting holes may be provided adjacent to each other in radial direction of the hub. The venting holes may have any cross-section proving the sand to slide from one surface to the other surface.

According to an embodiment, the first surface and the second surface may be axial surfaces of the hub and the sand venting holes may be substantially axial holes. Axial surfaces may be defined as surfaces having a normal along the axial direction of the hub. In particular, the axial surfaces spanning perpendicular to the normal axis of the hub. The same applies for the axial holes.

The presently described hub may further comprise a number of slopes to obtain the sand sliding from the first surface to the second surface and out of the hub. The slopes may be formed as ribs protruding in a radial direction of the cooling fan. For example, a hub structure may provide a number of slopes, ribs, transporting channels and/or venting holes. The number of slopes, ribs, transporting channels and venting holes may further guide and transport sand to slide out of the hub.

Advantageous embodiments and improvements of the present disclosure are found in the subordinate claims.

According to an embodiment of the disclosure, the first sand venting structure may comprise first ribs extending in a radial direction of the hub and first sliding surfaces between the first ribs. The first ribs may be provided adjacent to each other in circumferential direction of the hub. The first ribs and/or the first sliding surfaces may guide the sand to the venting holes.

According to an embodiment of the disclosure, the second sand venting structure may comprise second ribs extending in the radial direction and second sliding surfaces between the second ribs. The second ribs may be provided adjacent to each other in circumferential direction of the hub. The second ribs and/or the second sliding surfaces may guide the sand from the venting holes out of the hub.

The first and second sliding surfaces may be formed as slopes starting from an area near to a rotation axis of the hub and oriented away from the rotation axis. The sliding surfaces may be connected to the first or second ribs respectively.

According to an embodiment of the disclosure, the first ribs and/or the second ribs may be inclined regarding to the radial direction, in particular with an angle between 0° and 80°. Inclined surfaces may be oriented at an angle to the respective axis, e. g. at an angle to the radial axis. In particular, the angle may be in a range from 3° to 10°. Further, all first ribs may be inclined in the same angle or a variable angle to guide the sand.

According to an embodiment of the disclosure, the number of first ribs may differ from the number of second ribs. Thus, the number of first sliding surfaces may differ from the number of second sliding surfaces.

According to an embodiment of the disclosure, the first ribs and the second ribs may be staggered to one another with respect to a circumference direction. Thus, the first and second venting structure may be adapted respectively to guide the sand out of the hub.

According to an embodiment of the disclosure, the first sliding surfaces and/or the second sliding surfaces may be inclined regarding to the axial direction, in particular in an angle between 3° and 87°, in particular in an angle between 3° and 15°. The inclined surfaces may be oriented at an angle to the axial axis. In addition, or as an alternative embodiment, the first sliding surfaces and/or the second sliding surfaces may be inclined in a circumferential direction of the hub, in particular angled between 3° and 15°.

According to an embodiment of the disclosure, the first sliding surfaces and/or the second sliding surfaces may be inclined regarding to a radial direction, in particular in an angle between 3° and 15°. The inclined surfaces may be oriented at an angle to the radial axis. By angle the first sliding surfaces and/or the second sliding surfaces in the different direction, the sand may be guides more precise to the venting holes, in particular dependent on a centrifugal force.

According to an embodiment of the disclosure, the first sliding surfaces may be running parallel to the second sliding surfaces. The first sliding surfaces and/or the second sliding surfaces may be provided on opposite surfaces of one element, e. g. a panel element or a sheet, of the hub.

According to an embodiment of the disclosure, the venting holes may be located at an adjacent peripheral area of the first sliding surfaces and/or second sliding surfaces respectively. For example, the first sliding surfaces and/or second sliding surfaces may be located closer to the rotation axis of the hub as the venting holes. In other words, the first sliding surfaces and/or second sliding surfaces may be located closer to the rotation axis of the hub as the peripheral area. Thus, the sand may be guided by the first sliding surfaces and/or second sliding surfaces to the venting holes when the cooling fan rotates.

According to an embodiment of the disclosure, each peripheral area may form a sand transportation channel extending from an adjacent first rib to an adjacent venting hole. For example, the transportation channels may form a ring shape with the first ribs as radial ribs there between.

According to an embodiment of the disclosure, the hub may further comprise deflection areas configured to guide the sand to the respective venting hole, wherein in particular each deflection area may form a continuous curve having an angle between 3° and 80° regarding to the axial direction.

The deflection areas may be provided in extension of the first ribs respectively. Thus, a part of the first ribs may be used to form a part of the deflection area. The deflection area may start with an angle of 3° regarding to the axial direction and may end with an angle of 80° regarding to the axial direction. The transition between the deflection area and the peripheral area, e. g. the transportation channel, may be smooth to avoid turbulence of the sand when sliding to the venting hole.

According to an embodiment of the disclosure, each deflection area may forma continuous curve having an angle between 3° and 80° regarding to the radial direction.

According to an embodiment of the disclosure, the hub may further comprise a first radial rib connected to the first ribs, wherein the first radial rib may restrict the area of the first sand venting structure in the radial direction towards a centre of the hub, and/or a second radial rib, wherein the second radial rib may restrict the area of the first sand venting structure and/or the second sand venting structure in the radial direction away from a centre of the hub. In particular, the second radial rib may be a part of the peripheral area. According to an embodiment, the first and second sand venting structures may be provided between the first and second radial rib. The first and second radial rib may also guide the sand. In particular, the second radial rib as part of the peripheral area may be part of the transportation channel, and/or wherein the venting holes may be also provided in the second radial rib.

According to an embodiment of the disclosure, the first sliding surfaces may contact the first radial rib and/or the second radial rib. For example, the first and second sliding surface may start away from first radial rib and may end at the second radial rib, wherein a corner portion between the first sliding surfaces and the second radial rib may form the sand transporting channels.

According to an embodiment of the disclosure, the first sliding surfaces may be spaced from the second radial rib and/or forming tear-off edges to a side wall of the sand transportation channels respectively. According to the tear-off edges, some of the sand may slide away and drop out of the hub at the first sliding surface, e. g. at the first venting structure. In certain condition with fewer centrifugal force or fewer load of air flow, the tear-off edges are capable of removing the sand out of the hub as a simplified hub structure.

According to an embodiment of the disclosure, the first sliding surfaces may be spaced from the second radial rib and/or forming smoot transitions to a side wall of the sand transportation channels respectively. Instead of tear-off edges, smooth transition areas may be provided, wherein a radial part may form a smooth transition between the first sliding surface and the second radial rib.

According to an embodiment of the disclosure, the first sand venting structure and the second sand venting structure may be each forming 20 to 30 chambers, wherein each chamber may be restricted at least by two first or second ribs and one first or second sliding surface. The chambers may each have a same or different size. The chambers may be provided in circumferential direction to from a ring shape. The chambers may be formed by radial ribs connected to the sliding surfaces. Thus, the only "open" connection of the first and second venting structure may be the venting holes.

According to an embodiment of the disclosure, the first surface and the second surface may be axially surfaces of the hub. Thus, the first sand venting structure may be provided at a rear surface and the second sand venting structure may be provided at a front surface of the hub.

BRIEF SUMMARY OF THE DRAWINGS

The present disclosure is explained in more detail below with reference to the embodiments shown in the schematic figures.

Figure 1:
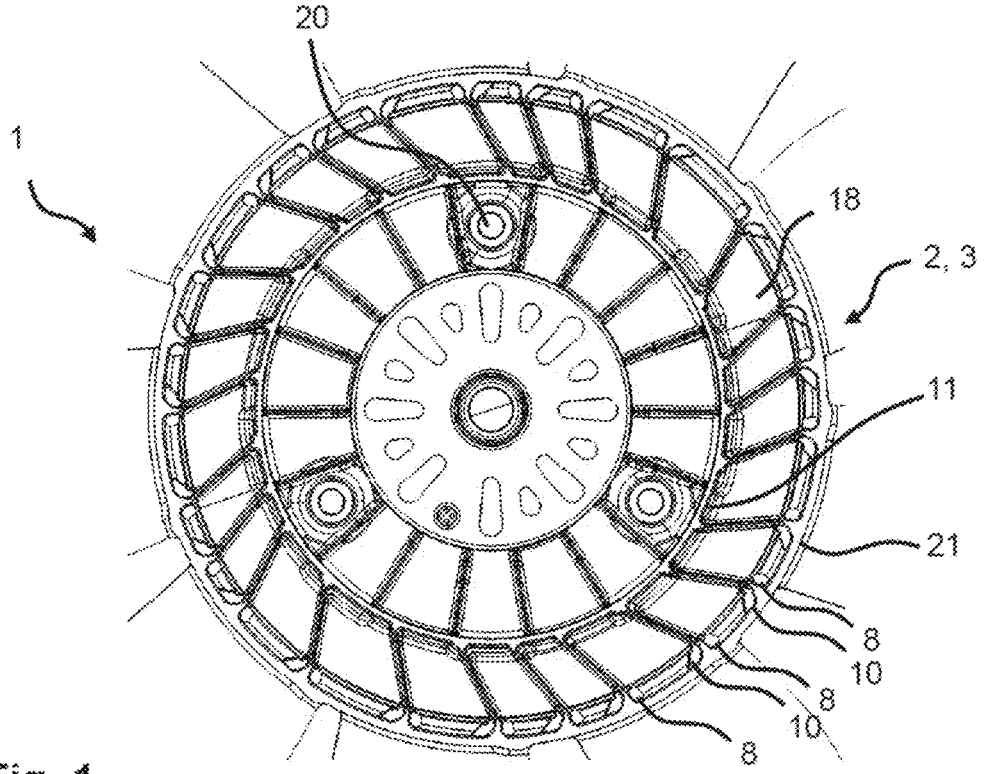
FIG. 1 depicts a view of a hub of a cooling fan according to an embodiment of the disclosure.

In the figures of the drawing, elements, features and components which are identical, functionally identical and of identical action are denoted in each case by the same reference designations unless stated otherwise.

Although specific embodiments are illustrated and described herein, it will be appreciated by those of ordinary skill in the art that a variety of alternate and/or equivalent implementations may be substituted for the specific embodiments shown and de-scribed without departing from the scope of the present disclosure. Generally, this application is intended to cover any adaptations or variations of the specific embodiments discussed herein.

DETAILED DESCRIPTION OF EMBODIMENTS

Figure 2:
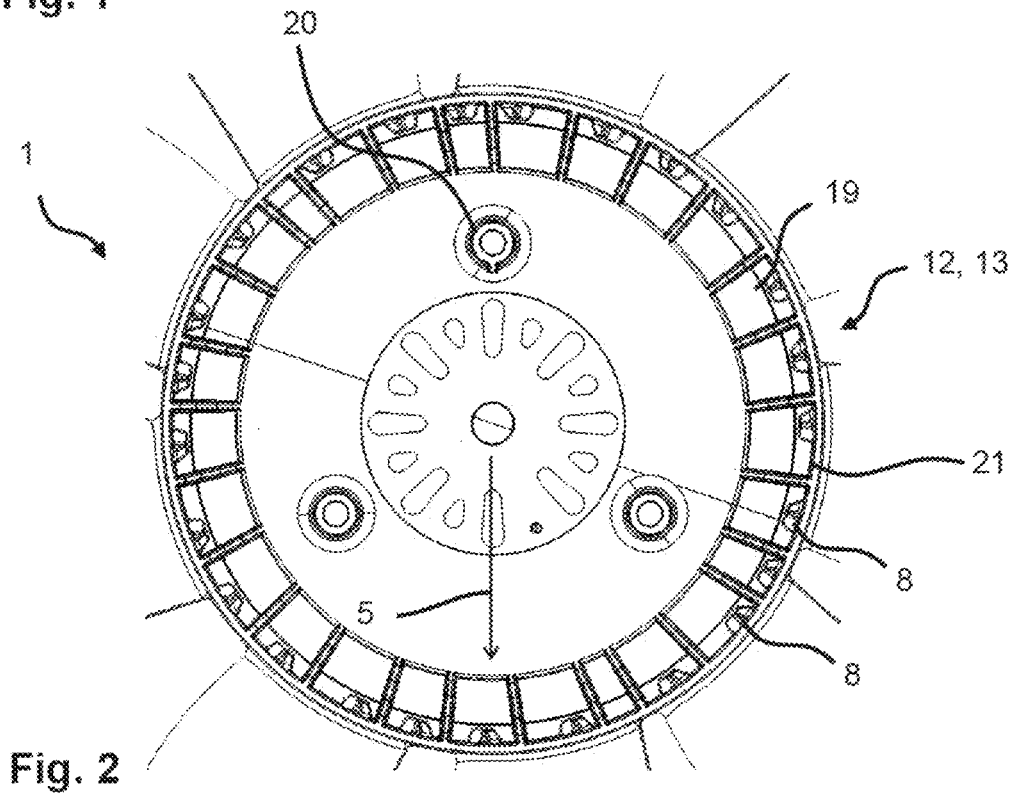
FIG. 2 depicts another view of a hub of a cooling fan according to an embodiment of the disclosure.

FIGS. 1 and 2 show a hub 1 of a cooling fan according to an embodiment of the disclosure. FIG. 1 shows a first surface 3, which may be a rear surface of the hub 1. FIG. 2 shows a second surface 13, which may be a front surface of the hub 1. At the first surface 3 the first sand venting structure 2 may be provided between a first radial rib 11 and a second radial rib 21. At the second surface 13 the second sand venting structure 12 may be provided between a first radial rib 11 and a second radial rib 21. The first radial rib 11 may be closer to a rotation axis of the hub 1 as the second radial rib 22 when viewing in a radial direction 5.

Chambers 18, 19 are provided in in circumferential direction of the hub 1. The chambers 18, 19 are formed by the first sand venting structure 2 or the second venting structure 12 respectively. The chambers 18, 19 are located at the same radial distance from the rotation axis of the hub 1.

Venting holes 8 are provided in circumferential direction of the hub 1. The venting holes 8 are oriented in axial direction of the hub 1. According to one embodiment, one venting hole 8 may be provided in each chamber 18, 19 to guide the sand from the chambers 18, 19 out of the hub 1. According to an embodiment, mounting surfaces or mounting holes 20 may be provided at the hub 1.

Figure 3:
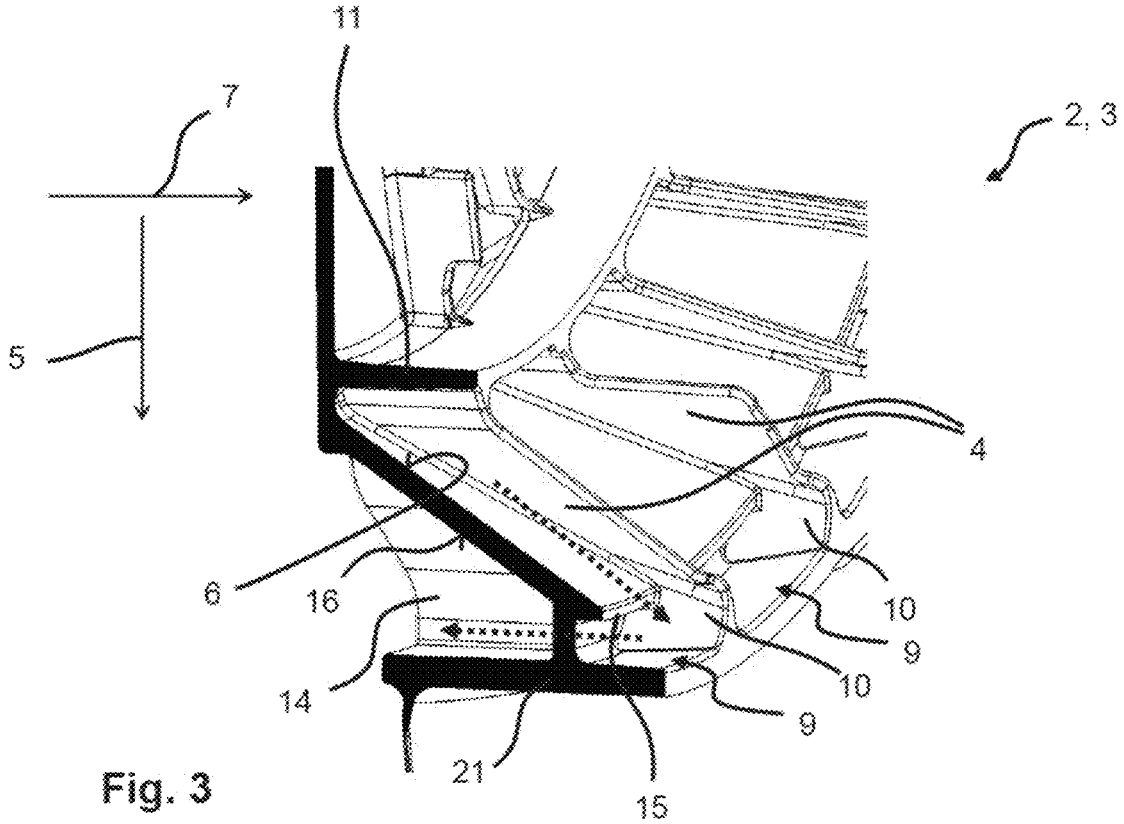
FIG. 3 depicts a cross-sectional view of a hub with sand venting structures.

FIG. 3 shows a cross-sectional view of a hub 1. The first sand venting structure 2 comprises first ribs 4 and first sliding surfaces 6. The first ribs 4 and first sliding surfaces 6 may be connected to each other to form a sliding channel of a chamber 18. In a peripheral area of the first sliding surface 6 a sand transportation channel 9 may be provided to guide the sand to the venting hole 8.

The sand venting directions in the figures in the first and second venting structure 2, 12 are marked by the dotted arrows.

According to the embodiment, the first sliding surface 6 is spaced from the first and second radial rib 11, 21 and forms a tear-off edge 15. The sand transportation channel 9 may be located below the tear-off edge 15.

The second sand venting structure 12 may comprise second ribs 14 and second sliding surfaces 16. The second ribs 14 and second sliding surfaces 16 may be connected to each other to form a sliding channel of a chamber 19.

Figure 4:
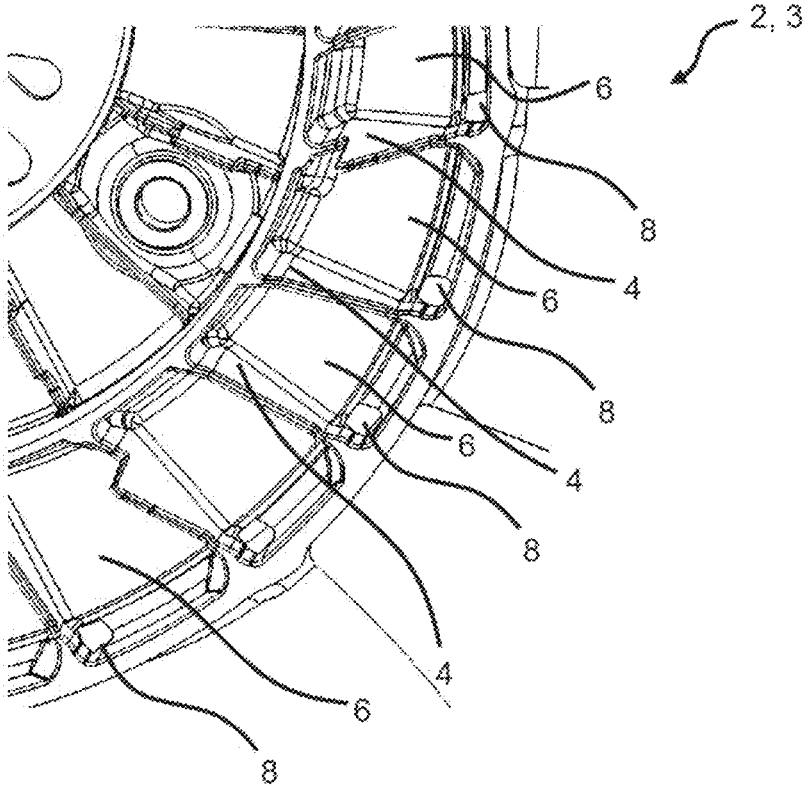
FIG. 4 depicts a detail of the embodiment of FIG. 1.

FIG. 4 shows a detail of the embodiment of FIG. 1. The first sand venting structure 2 may further comprise deflection areas 10, in particular one deflection area 10 in each chamber 18. The deflection area 10 may be located at a corner part of the chamber 18, in particular opposite to a corner part where the venting hole 8 is located.

Figure 5:
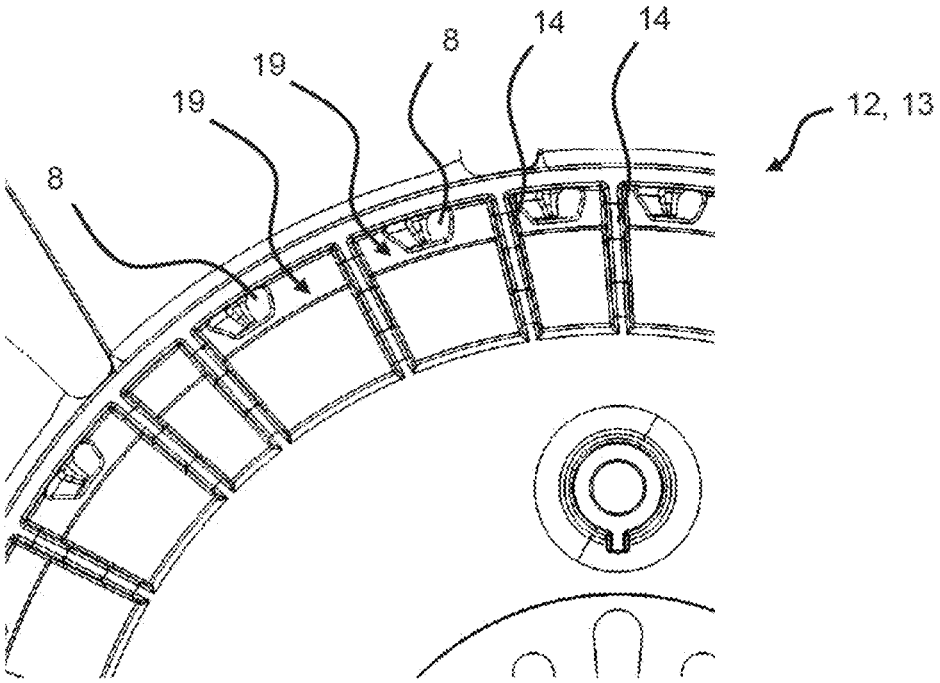
FIG. 5 depicts a detail of the embodiment of FIG. 2.

FIG. 5 shows a detail of the embodiment of FIG. 2. In contrast to the first venting structure 2, the venting holes 8 may be provided at middle parts of the chambers 19. This may be achieved by shifting the second ribs 14 relative to the first ribs 4.

Figure 6:
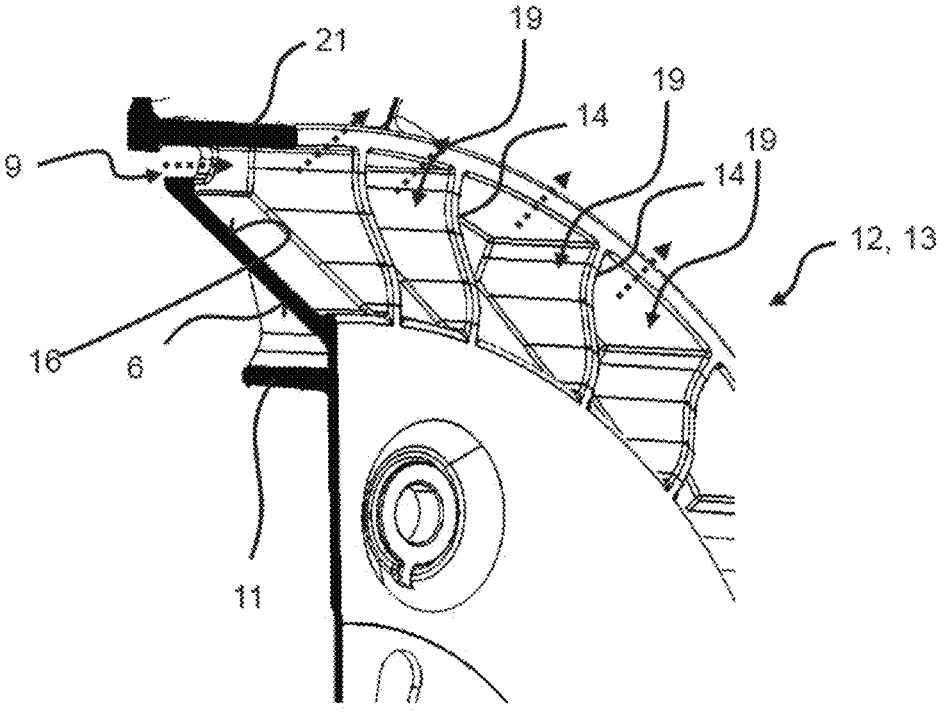
FIG. 6 depicts a cross-sectional view of a hub according to FIG. 5.

FIG. 6 shows a cross-sectional view of a hub according to FIG. 5 from the second surface 13. The sand may be guided out of the second chambers 19 by the second sand venting structure 12.

Figure 7:
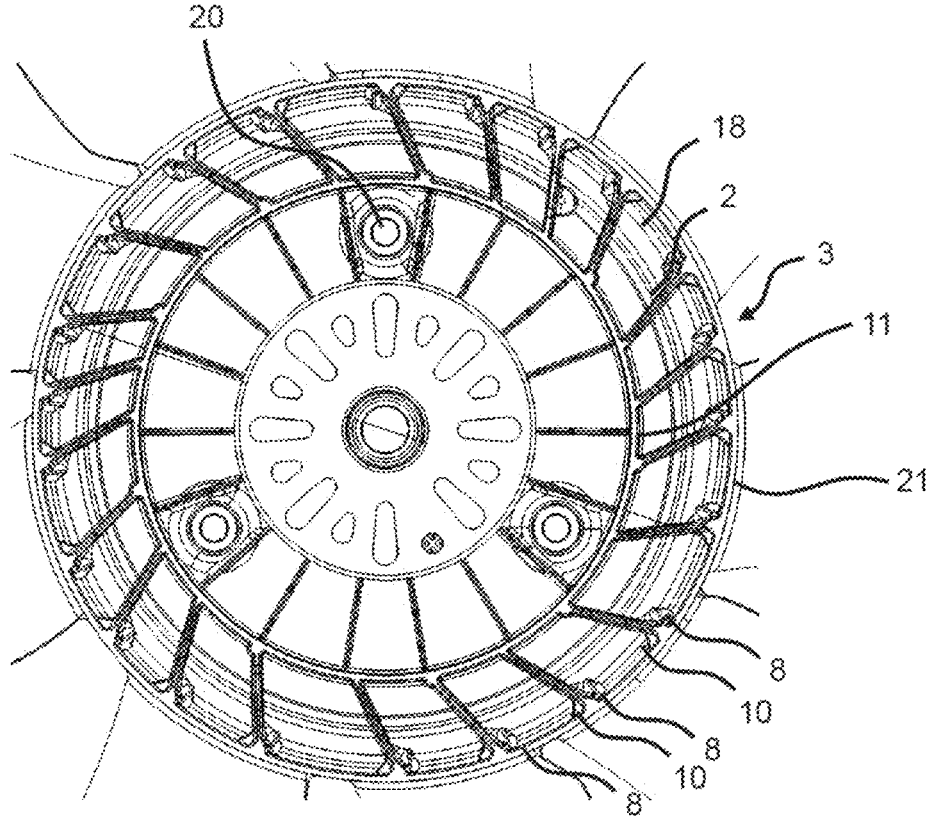
FIG. 7 depicts a view of a hub of a cooling fan according to another embodiment of the disclosure.
Figure 8:
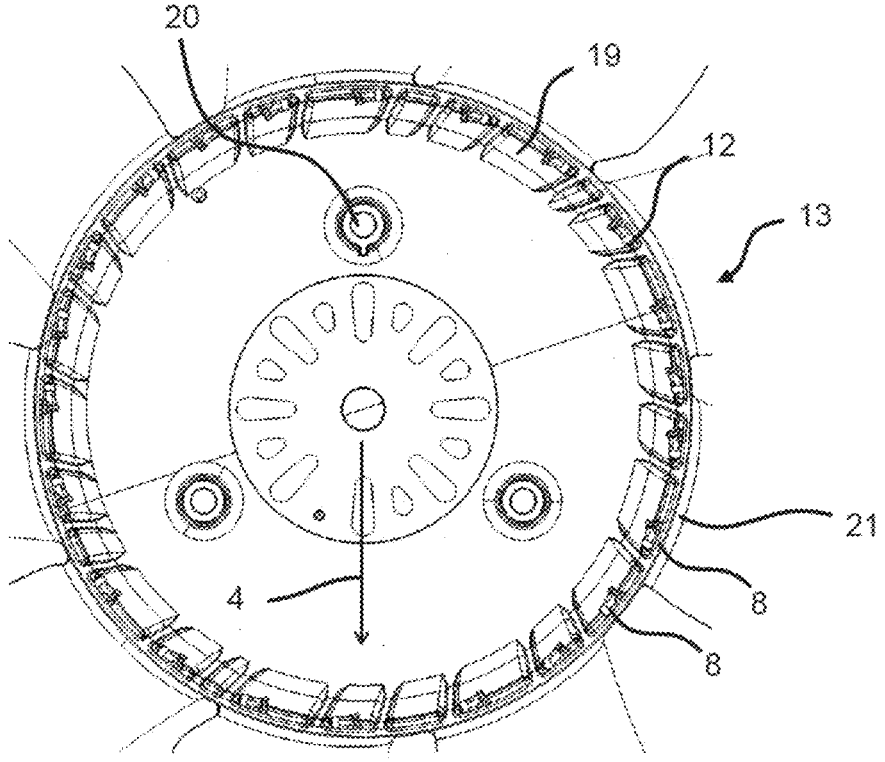
FIG. 8 depicts another view of a hub of a cooling fan according to another embodiment of the disclosure.

FIGS. 7 and 8 show a hub 1 of a cooling fan according to another embodiment of the disclosure. FIG. 7 shows a first surface 3, which may be a rear surface of the hub 1. FIG. 8 shows a second surface 13, which may be a front surface of the hub.

Figure 9:
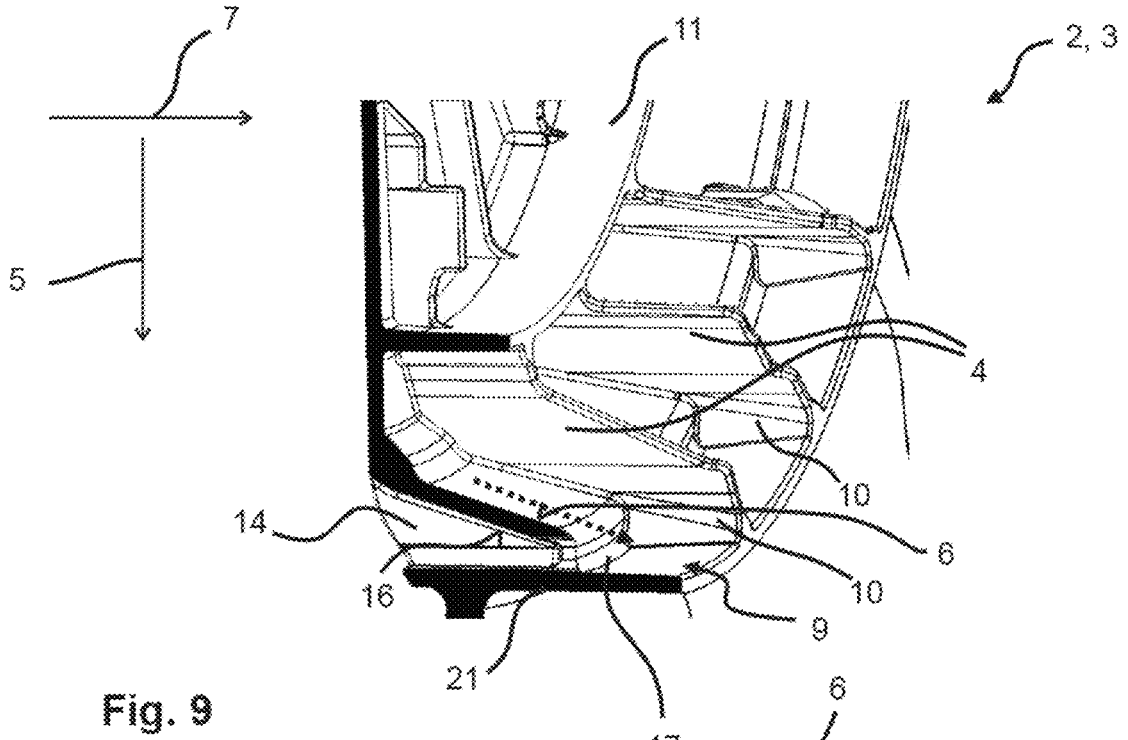
FIG. 9 depicts a cross-sectional view of a hub with sand venting structures according to another embodiment of the disclosure.

FIG. 9 shows a cross-sectional view of a hub 1 according to another embodiment of the disclosure. In contrast to the embodiment of FIG. 3, the first sliding surface 3 forms a smooth transition 17 instead of a tear-off edge. The smooth transition 17 may be provided by a radial part connecting the first sliding surface 6 with the second radial rib 21. Further and with regard to FIG. 3, the first sliding surface 4 is inclined in a different angle relative to the axial direction 7. The angle may be adapted to the centrifugal force of the sand in the hub 1.

Figure 10:
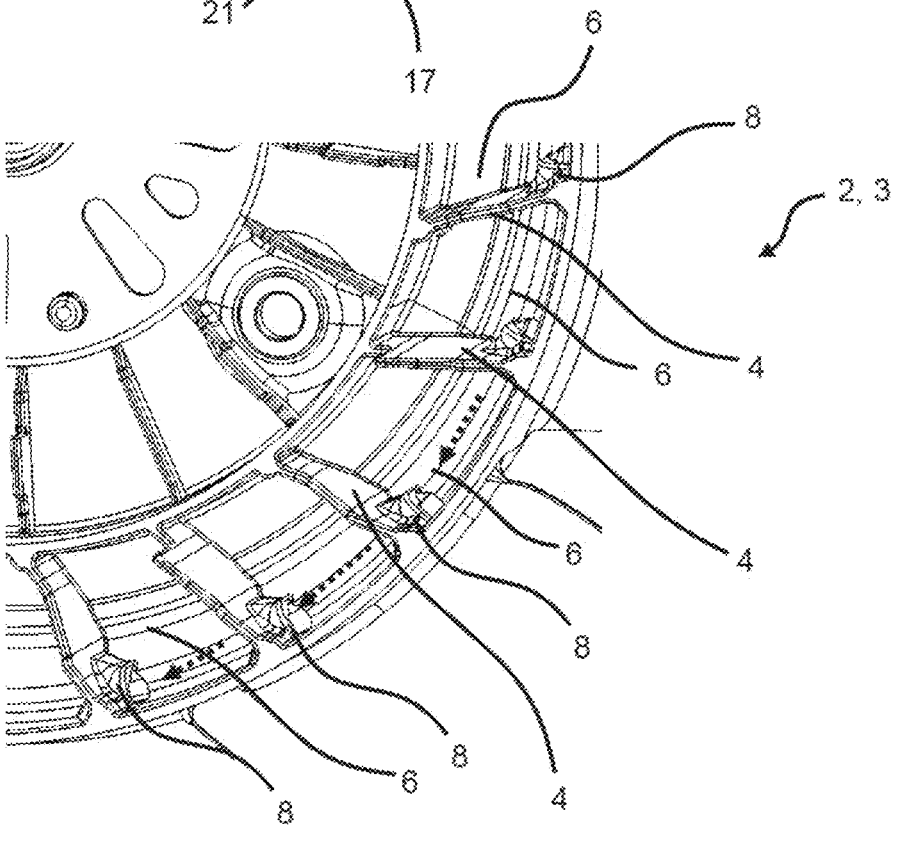
FIG. 10 depicts a detail of the embodiment of FIG. 7.

FIG. 10 shows a detail of the embodiment of FIG. 7. The first ribs 4 are inclined with respect to the radial direction 5 of the hub 1. As shown in FIG. 10, the ribs 4 may have different angles to optimize the sand venting structure.

Figure 11:
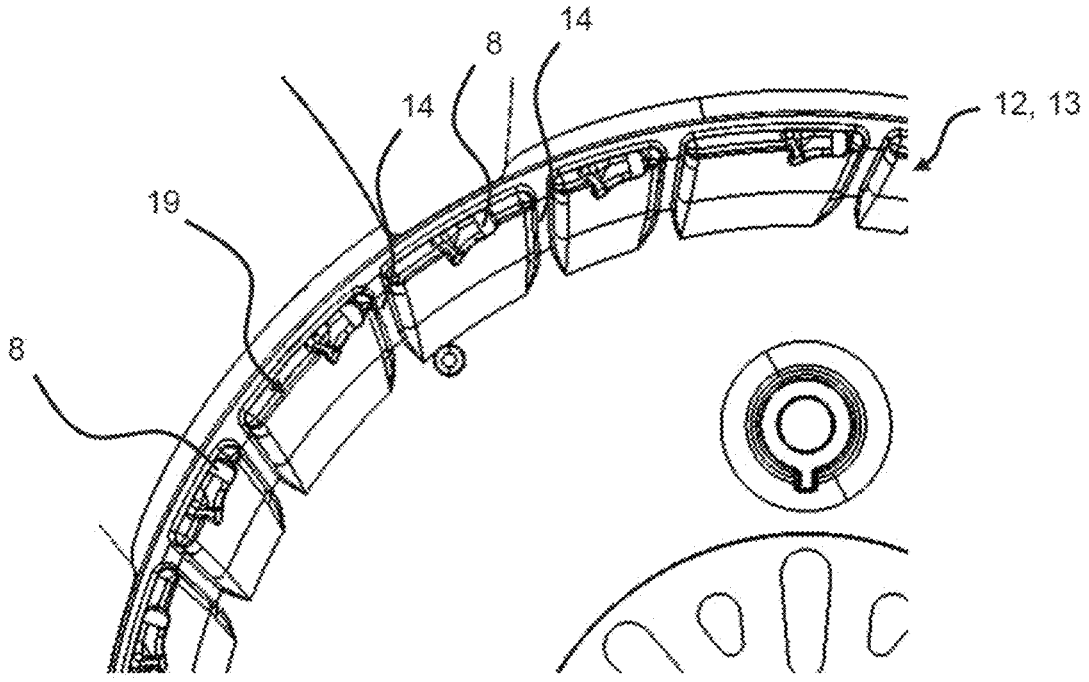
FIG. 11 depicts a detail of the embodiment of FIG. 8.

FIG. 11 shows a detail of the embodiment of FIG. 8, wherein the second ribs 14 may have different angles to optimize the sand venting structure.

Figure 12:
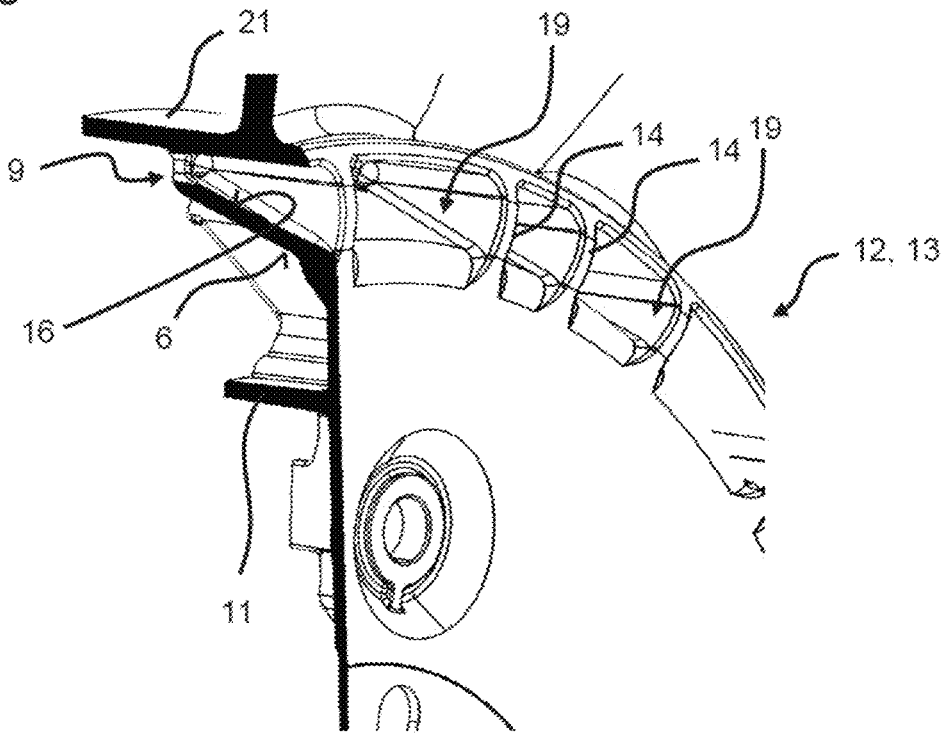
FIG. 12 depicts a view of a hub of a cooling fan according to another embodiment of the disclosure.

FIG. 12 shows a view of a hub 1 of a cooling fan according to another embodiment of the disclosure. The first sliding surface 6 and the second sliding surface 16 are parallel to each other, wherein the surfaces 6, 16 are opposite surfaces of the same element, e. g. a panel element or a sheet of the hub 1.

Figure 13:
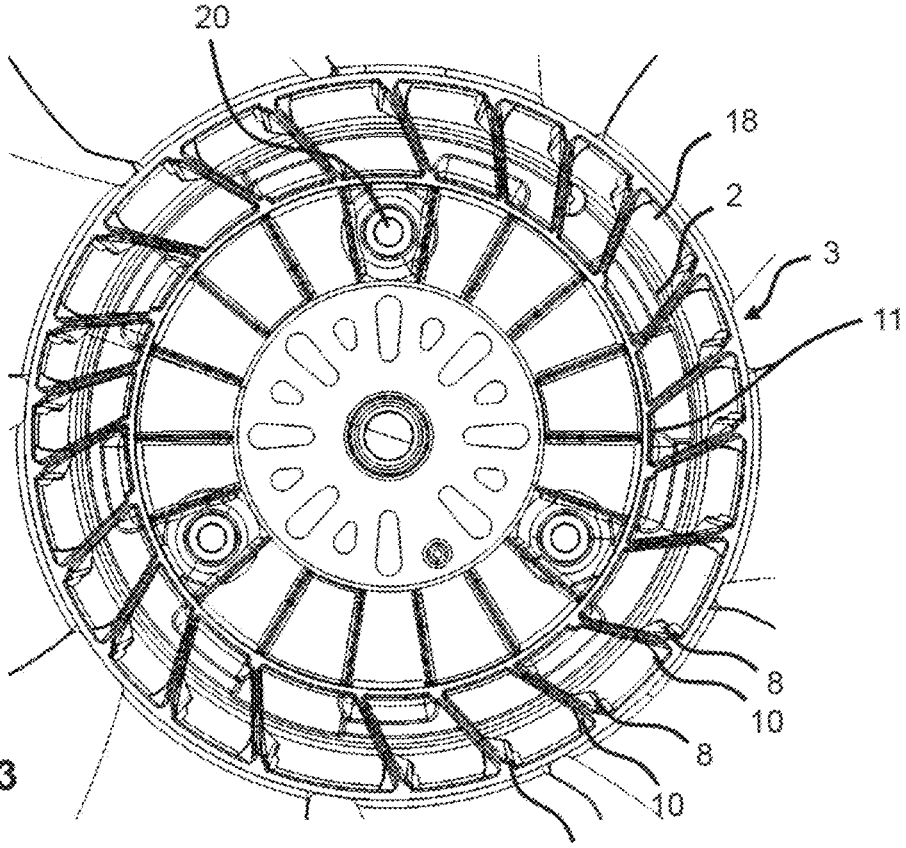
FIG. 13 depicts a view of a hub of a cooling fan according to another embodiment of the disclosure.
Figure 14:
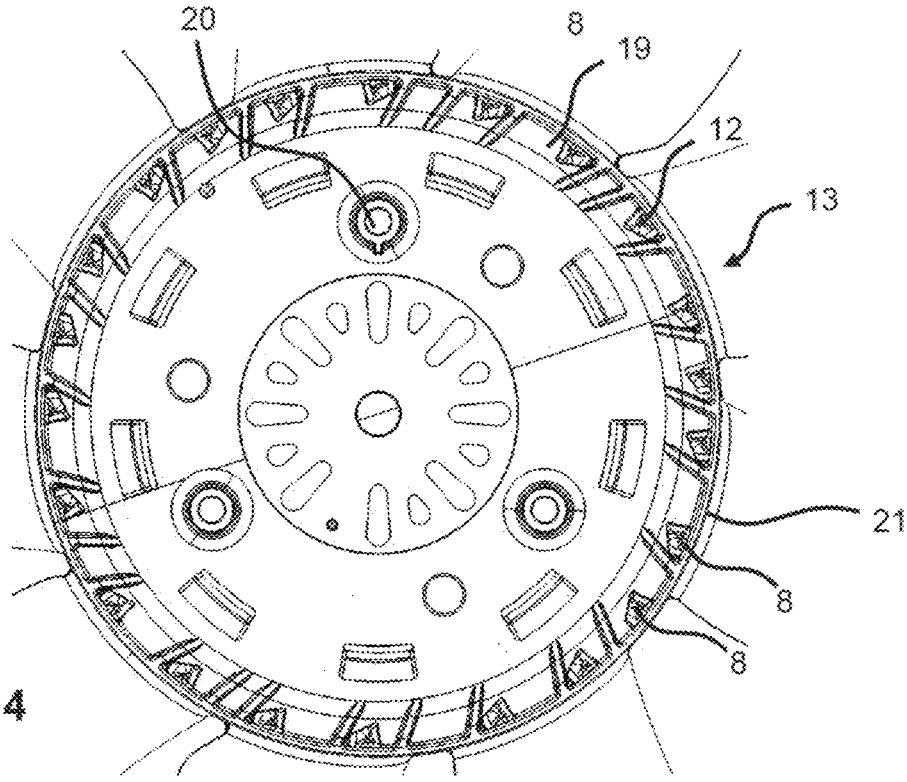
FIG. 14 depicts cross-sectional views according to the embodiment of FIG. 12.
Figure 17:
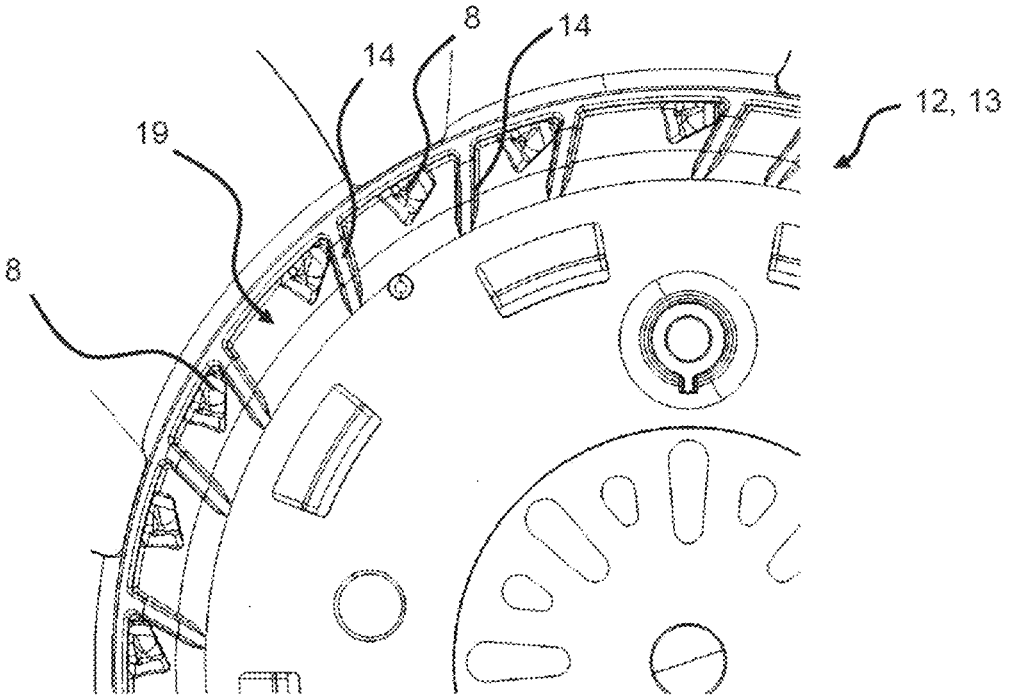
FIG. 17 depicts a detail of the embodiment of FIG. 14.

FIGS. 13 and 14 show a hub 1 of a cooling fan according to another embodiment of the disclosure. As shown in FIG. 14, the second sand venting structure 12 may provide chambers without a venting hole 8 by shifting the second ribs 14, see FIGS. 14 and 17.

Figure 15:
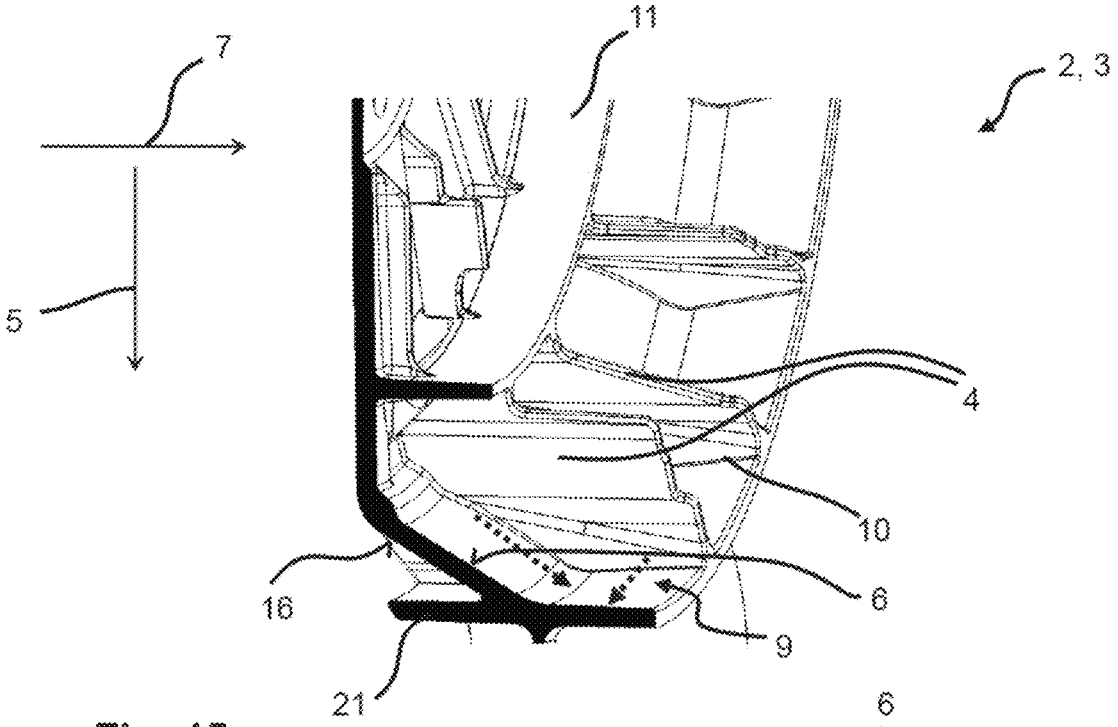
FIG. 15 depicts a cross-sectional view of a hub with sand venting structures.

FIG. 15 shows a cross-sectional view of a hub 1. The sliding surfaces 4, 14 starting at a position away from the first radial rib 11, wherein a radial part may connect the sliding surfaces 4, 14 with the radial rib 11. The sand transportation channel 9 is located at an edge portion between the second radial rib 21 and the first sliding surface 4, wherein the sand transportation channel 9 is formed from the second radial rib 21 and the first sliding surface 4.

Figure 16:
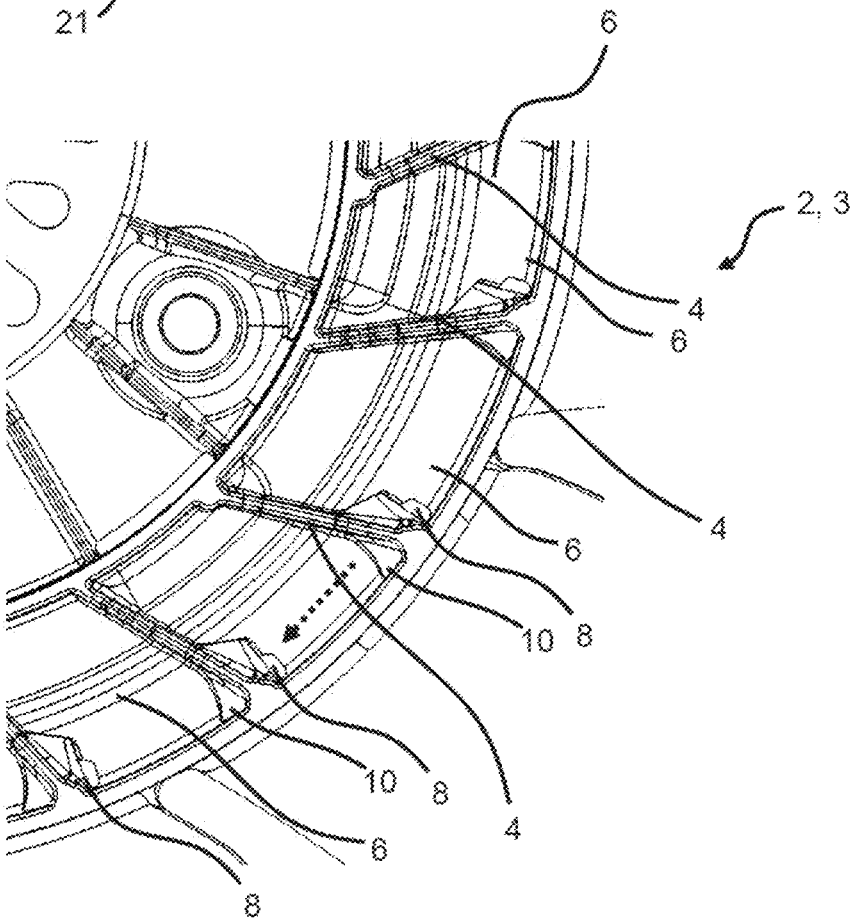
FIG. 16 depicts a detail of the embodiment of FIG. 13.

FIG. 16 shows a detail of the embodiment of FIG. 13. The deflection areas 10 are configured to guide the sand to the respective venting hole 8, wherein in particular each deflection area may form a continuous curve having an angle between 3° and 80° regarding to the axial direction 7.

The deflection areas 10 may be provided in extension of the first ribs 4 respectively. Thus, a part of the first ribs 4 may be used to form a part of the deflection area 10.

For example, the deflection area 10 may start with an angle of 3° regarding to the axial direction 7 or a radial direction 5 and may end with an angle of 80° regarding to the axial direction 7 or a radial direction 5, see FIGS. 3, 4, 9, 10, 15 and 16. The transition between the deflection area 10 and the peripheral area, e. g. the sand transportation channel 9, may be smooth to avoid turbulence of the sand when sliding to the venting hole 8.

Figure 18:
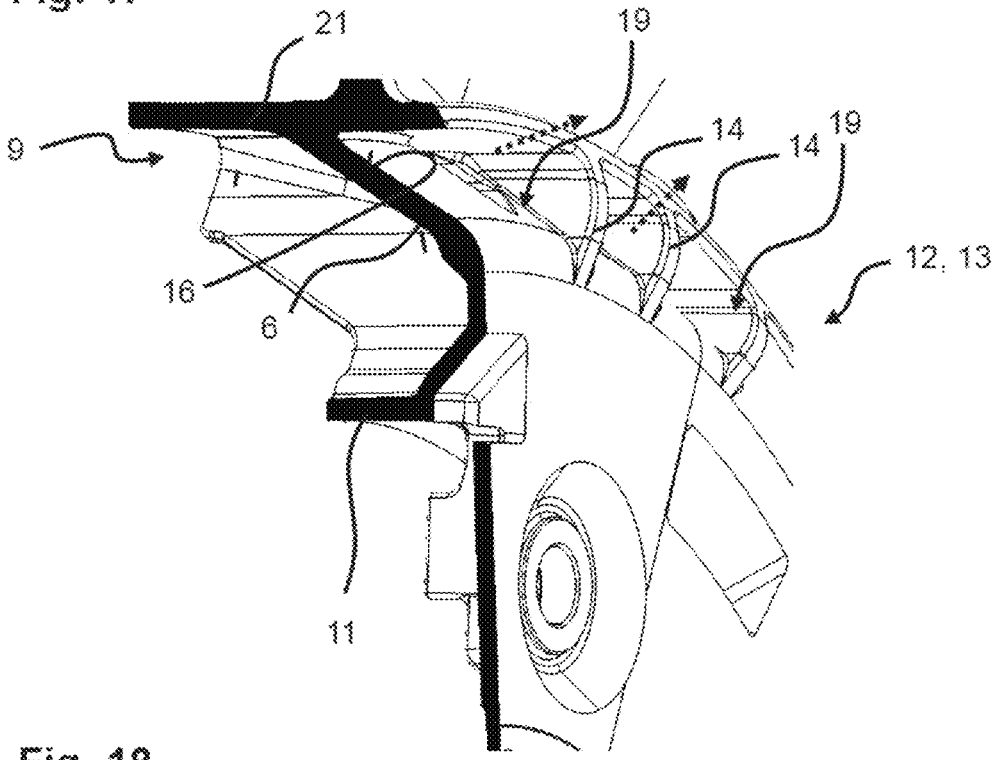
FIG. 18 depicts a cross-sectional view of a hub with sand venting structures.

FIG. 18 shows a cross-sectional view of a hub 1 from a second sand venting structure 14. The chambers 19 are formed from the second ribs 14 connecting the second sliding surfaces 16.

In the foregoing detailed description, various features are grouped together in one or more examples or examples with the purpose of streamlining the disclosure. It is to be under-stood that the above description is intended to be illustrative, and not restrictive. It is intended to cover all alternatives, modifications and equivalents. Many other examples will be apparent to one skilled in the art upon reviewing the above specification. The embodiments were chosen and described in order to best explain the principles of the disclosure and its practical applications, to thereby enable others skilled in the art to best utilize the disclosure and various embodiments with various modifications as are suited to the particular use contemplated.

REFERENCE LIST hub
first sand venting structure
first surface
first rib
radial direction
first sliding surface
axial direction
venting hole
sand transportation channel
deflection area
first radial rib
second sand venting structure
second surface
second rib
tear-off edge
second sliding surface
smoot transition
chamber
chamber
mounting surface
second radial rib

The invention claimed is:

1. A hub for a cooling fan, comprising:

a first sand venting structure at a first surface of the hub;

a second sand venting structure at a second surface of the hub; and venting holes connecting the first surface and the second surface, wherein the first sand venting structure is configured to transport sand to the venting holes and the second sand venting structure is configured to transport the sand out of the hub from the venting holes wherein the first sand venting structure comprises first ribs extending in a radial direction of the hub and first sliding surfaces between the first ribs, wherein the second sand venting structure comprises second ribs extending in the radial direction and second sliding surfaces between the second ribs, wherein at least one of the first ribs and the second ribs are inclined in relation to the radial direction, and wherein the first ribs and the second ribs are staggered to one another in relation to a circumference direction.

2. The hub of claim 1, wherein a quantity of the first ribs is different than a quantity of second the ribs.

3. The hub of claim 1, wherein the first sliding surfaces and the second sliding surfaces are inclined with respect to an axial direction at an angle between 3° and 87°.

4. The hub of claim 1, wherein the first sliding surfaces and the second sliding surfaces are inclined in relation to a radial direction.

5. The hub of claim 1, wherein the first sliding surfaces are parallel to the second sliding surfaces.

6. The hub of claim 1, wherein the venting holes are located at adjacent peripheral areas of the first sliding surfaces and the second sliding surfaces.

7. The hub of claim 6, wherein each peripheral area of the adjacent peripheral areas forms a sand transportation channel extending from an adjacent first rib of the first ribs to an adjacent venting hole of the venting holes.

8. The hub of claim 1, further comprising deflection areas configured to guide the sand to the respective venting hole, wherein each of the deflection areas form a continuous curve having an angle between 3° and 80° in relation to an axial direction.

9. The hub of claim 1, further comprising a first radial rib connected to the first ribs, wherein the first radial rib restricts an area of the first sand venting structure in the radial direction towards a center of the hub, and/a second radial rib, wherein the second radial rib restricts the area of the first sand venting structure and/or the second sand venting structure in the radial direction away from a center of the hub.

10. The hub of claim 9, wherein the first sliding surfaces contact the first radial rib and the second radial rib, or wherein the first sliding surfaces are spaced from the second radial rib and forming tear-off edges or smooth transitions to a side wall of the sand transportation structures.

11. The hub of claim 1, wherein the first sand venting structure and the second sand venting structure each forming chambers, wherein each chamber is restricted at least by one of the first ribs or one of the second ribs and one of the first sliding surfaces or one of the second sliding surfaces.

12. The hub of claim 1,, wherein the first surface and the second surface are axial surfaces of the hub.

13. The hub of claim 1, wherein at least one of the first ribs and the second ribs form an angle with respect to the radial direction form an angle ranging between 0° and 80°.

14. A cooling fan comprising:

a hub including a first surface and a second surface;

a first sand venting structure integrally connected to the first surface;

a second sand venting structure integrally connected to the second surface; and venting holes integrally formed within the first surface and the second surface, the venting holes are configured to transport sand from the first sand venting structure to the second sand venting structure wherein the first sand venting structure comprises first ribs extending in a radial direction of the hub and first sliding surfaces between the first ribs, wherein the second sand venting structure comprises second rubs extending in a radial direction and second sliding surfaces between the second ribs, wherein at least one of the first ribs and the second ribs are inclined in relation to the radial direction, and wherein the first ribs and the second ribs are staggered to one another in relation to a circumference direction.

15. The cooling fan of claim 14, wherein the first sand vent comprises first ribs extending in a radial direction of the hub and first sliding surfaces between the first ribs, wherein the second sand vent comprises second ribs extending in a radial direction and second sliding surfaces between the second ribs.

16. The cooling fan of claim 15, wherein the number of first ribs is distinct from the number of second ribs.

* * * * *